United States Patent [19]

Altenpohl, deceased et al.

[11] 4,377,929

[45] Mar. 29, 1983

[54] PRE-ENTRY POSITIONING POULTRY BAGGING SYSTEM

[75] Inventors: William F. Altenpohl, deceased, late of High Point, N.C., by Helen C. Altenpohl, executrix; Paul J. Altenpohl, High Point, N.C.

[73] Assignee: W. F. Altenpohl, Inc., High Point, N.C.

[21] Appl. No.: 167,523

[22] Filed: Jul. 11, 1980

Related U.S. Application Data

[63] Continuation-in-part of Ser. No. 6,238, Jan. 24, 1979, Pat. No. 4,245,453, Continuation-in-part of Ser. No. 956,994, Oct. 31, 1978, Pat. No. 4,221,106, Continuation-in-part of Ser. No. 845,231, Oct. 25, 1977, abandoned.

[51] Int. Cl.[3] ..... B65B 39/02; B65B 43/36

[52] U.S. Cl. ..... 53/572; 53/258; 53/385

[58] Field of Search ..... 53/572, 502, 258, 530, 53/261, 385, 384, 74

[56] References Cited

U.S. PATENT DOCUMENTS

| | | | |
|---|---|---|---|
| 3,206,913 | 9/1965 | Fleigher et al. | 53/572 |
| 3,930,352 | 1/1976 | Carnes | 53/572 |
| 3,971,191 | 7/1976 | Hoyland | 53/258 X |
| 3,988,874 | 4/1976 | Altenpohl et al. | 53/502 X |
| 4,062,169 | 12/1977 | Lister et al. | 53/258 X |
| 4,157,003 | 6/1979 | Kamphaus | 53/258 X |
| 4,219,987 | 9/1980 | Andrews | 53/572 |
| 4,241,562 | 12/1980 | Meyer | 53/258 X |
| 4,245,453 | 1/1981 | Altenpohl et al. | 53/530 |

*Primary Examiner*—James F. Coan

*Attorney, Agent, or Firm*—Harvey B. Jacobson

[57] ABSTRACT

Poultry dropped from a moving conveyor impacts on a slide surface and is aligned by positioners with a path of entry into bags established by a nozzle assembly that expands each bag in advance of bird entry. A ram packs each bird fully into the bag after alignment thereof followed by detachment of the bag and drop onto a receiving surface.

10 Claims, 10 Drawing Figures

PRE-ENTRY POSITIONING POULTRY BAGGING SYSTEM

BACKGROUND OF THE INVENTION

The present application is a continuation-in-part of prior application Ser. No. 845,231 filed Oct. 25, 1977, and now abandoned, and Ser. No. 956,994 filed Oct. 31, 1978 which is now U.S. Pat. No. 4,221,106, and Ser. No. 006,238 filed Jan 24, 1979, which is now U.S. Pat. No. 4,245,453.

According to our prior art copending applications, a method and apparatus for packaging poultry in bags in an automatic fashion is disclosed. The poultry products are of such size relative to the bags as to obtain a close fit. Although automatic bagging of regular machine-made products within packaging containers is well-known, because of the irregularities in contour and variations in weight distribution associated with poultry, no successful automatic, close-fit bagging of suspended poultry dropped from a moving conveyor was deemed feasible because of tumbling and dimensional interference. It was discovered, however, that such automatic bagging could be effected as a practical matter if the products when dropped from the moving conveyor were permitted to undergo limited free fall before impact with a fixed, inclined slide plate for continued guided descent into a flexible film bag inflated by a stream of air and expanded somewhat prior to product entry.

One of the conditions for such successful automatic bagging by the foregoing apparatus is the existence of a moist external surface on the poultry product being bagged, exhibiting a low friction property upon contact with the stainless steel surface of the fixed, inclined slide plate. Under certain poultry processing operations, however, such as soft scald or air chilling, the surface of the poultry product becomes extremely dry. A relatively higher frictional condition is then exhibited by the product relative to the slide surface, making entry into the bag erratic and unreliable.

It is therefore an important object of the present invention to increase the operational reliability of an automatic bagging system of the aforementioned type so as to accommodate poultry products having different frictional surface characteristics.

SUMMARY OF THE INVENTION

In accordance with the present invention, poultry dropped from a moving conveyor or deposited onto a fixed, inclined slide surface of a bagging device, for guided descent along an entry path into an appropriately sized bag, is laterally positioned relative to said entry path before before entry into the bag through a nozzle assembly projected into the open end of the bag in advance of poultry entry. The nozzle assembly includes laterally spaced, confronting members forming a convergent entry passage that is laterally expanded in two stages to effect dimensional enlargement of the open portion of the bag while the product is being laterally positioned on the slide surface for alignment with the entry path.

The product is then impelled along the expanded passage of the nozzle assembly by a packing ram. Withdrawal of the ram and retraction of the nozzle assembly and the product positioners permits contraction of the bagging material about the product and detachment of the bagged product and readies the apparatus for the next automatic bagging cycle. The bagged product when detached from its bag supporting rack drops onto a receiving surface.

Pivotal movement is imparted to the confronting nozzle members of the entry nozzle assembly during a first stage of operation by means of a linkage system with which a stage control sensor is associated to detect the end of the first stage and initiate a second stage of operation during which a lateral component of movement imparted to the nozzle members causes dimensional enlargement of the bag. The bag is clamped to the nozzle members and the pre-entry positioners are activated during the second stage of operation before delayed operation of the packing ram ensues to complete the bagging cycle. A control circuit is interfaced with the entry nozzle, the bag clamping devices, the pre-entry positioners and the ram through piston control devices to control the operational cycle. The control circuit includes the aforementioned stage control sensor detecting the end of the first stage of operation as well as a limit sensor to detect the end of the bagging cycle for reset purposes.

The angle of incline of the fixed slide surface, which is less than 45°, is less steep than that associated with apparatus disclosed in the aforementioned prior copending applications, to avoid tumbling upon impact of the product with the surface. Further, in view of the use of pre-entry positioners, some deviation from acceptable product orientation upon impact is tolerable in accordance with the present invention.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF THE PREFERRED EMBODIMENT

Figure 1:
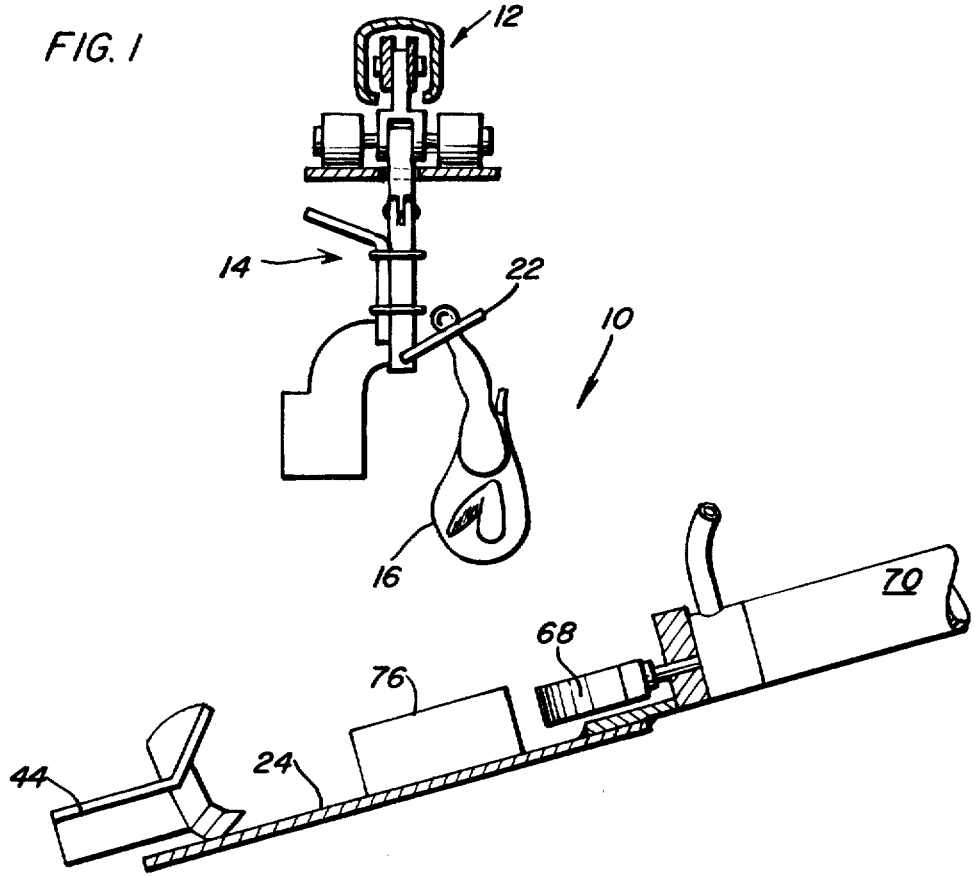
FIG. 1 is a somewhat simplified section view through apparatus at a bagging station in accordance with the present invention.

Referring now to the drawings in detail, an automatic bagging station generally referred to by reference numeral 10 is located below an overhead conveyor 12 in a poultry processing plant as shown in FIG. 1. By means of the overhead conveyor 12, poultry carriers generally referred to by reference numeral 14 convey birds 16 to the bagging station at which they are automatically dropped for limited free fall. In a manner well-known in the art, dropping of a bird produces a signal to initiate an automatic bagging cycle as will be explained in detail hereinafter.

As disclosed in our prior copending applications aforementioned, the birds conveyed to the station 10 are suspended by means of hooks 22 associated with the poultry carriers 14. When released, each bird undergoes free fall before impact with a fixed, inclined slide surface 24 associated with a bagging device generally referred to by reference numeral 30. The slide surface is supported by a frame assembly, generally referred to by reference numeral 26 as more clearly seen in FIG. 2, at an incline between 0° and 45°. The bagging device 30 as more clearly seen in FIG. 3 includes a rack plate 34 on which a stack of film bags 32 are supported. The rack plate is movably mounted in parallel spaced relationship to the slide surface 24 by a pair of link assemblies 25. A piston rod 27 extended from a fluid piston device 29 engages the underside of the rack plate to exert an upward bias thereon thereby elevating the stack of bags for clamping thereof at the flap portions against the underside of an extension 31 of a discharge nozzle 40 associated with an air blower 36. The top bag on the plate 34 is inflated by a stream of air discharged by the air blower through the nozzle 40 in preparation for entry of the product into the topmost bag. The bags are held in position on the rack plate by a U-shaped holder 33 depending from extension 31, on which the holder is mounted by means of a clip 35.

Figure 7:
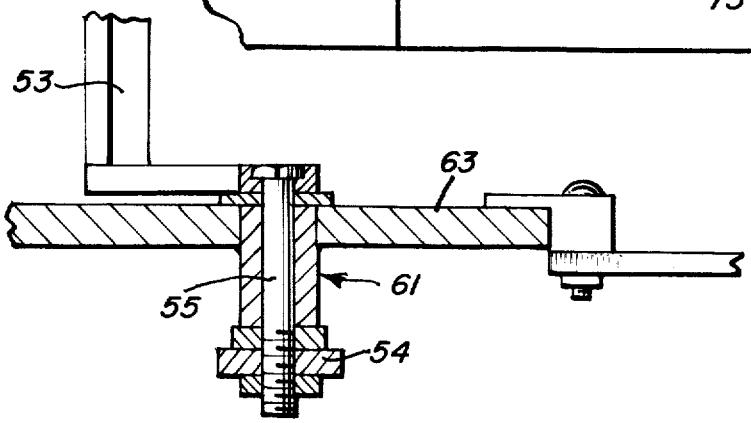
FIG. 7 is an enlarged partial section view taken substantially through a plane indicated by section line 7—7 in FIG. 4.
Figure 4:
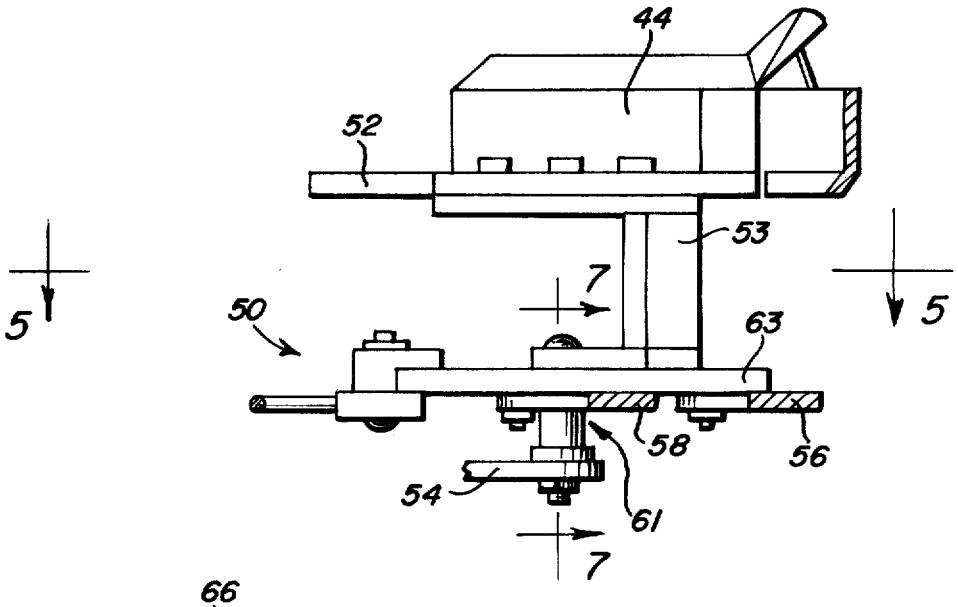
FIG. 4 is an enlarged partial section view taken substantially through a plane indicated by section line 4—4 in FIG. 2.

An adjustable entry nozzle assembly generally referred to by reference numeral 42 is associated with the bagging device in order to establish an entry passage into the topmost bag in advance of the product undergoing guided descent into the bag. The nozzle assembly includes a pair of confronting nozzle members or horns 44 that are laterally spaced from each other in convergent relation to define a variable, cross-sectional area of the entry passage. An actuator link assembly generally referred to by reference numeral 50 is mounted by the frame assembly 26 as more clearly seen in FIGS. 4, 5 and 8 and is connected to each of the nozzle members 44 in order to project of the nozzle assembly into the top opened bag and undergoes expansion once inserted into the bag. The actuator linkage assembly 50 includes an arm 52 extending laterally from each nozzle member 44 and adjustably mounted on the upper end of a movable support post 53 connected to a linkage connector arm 54 which is pivotally mounted by a pivot assembly 61 on a reciprocable support plate 63. The plate 63 is interconnected with the frame by means of a pair of parallel links 56 and 58 so as to constrain movement of the pivot 61 when an actuating force is applied to the linkage assembly by a piston rod 64 extending from a fluid operated, piston control 66 as more clearly seen in FIG. 5. The piston rod 64 is connected by an arm 62 to a connecting link 60, which in turn is pivotally connected to the arm 54. The arm 54 is rigidly connected to the post 53 by means of a connecting bolt 55, for example, extending through the pivot assembly 61 as more clearly seen in FIG. 7.

Figure 2:
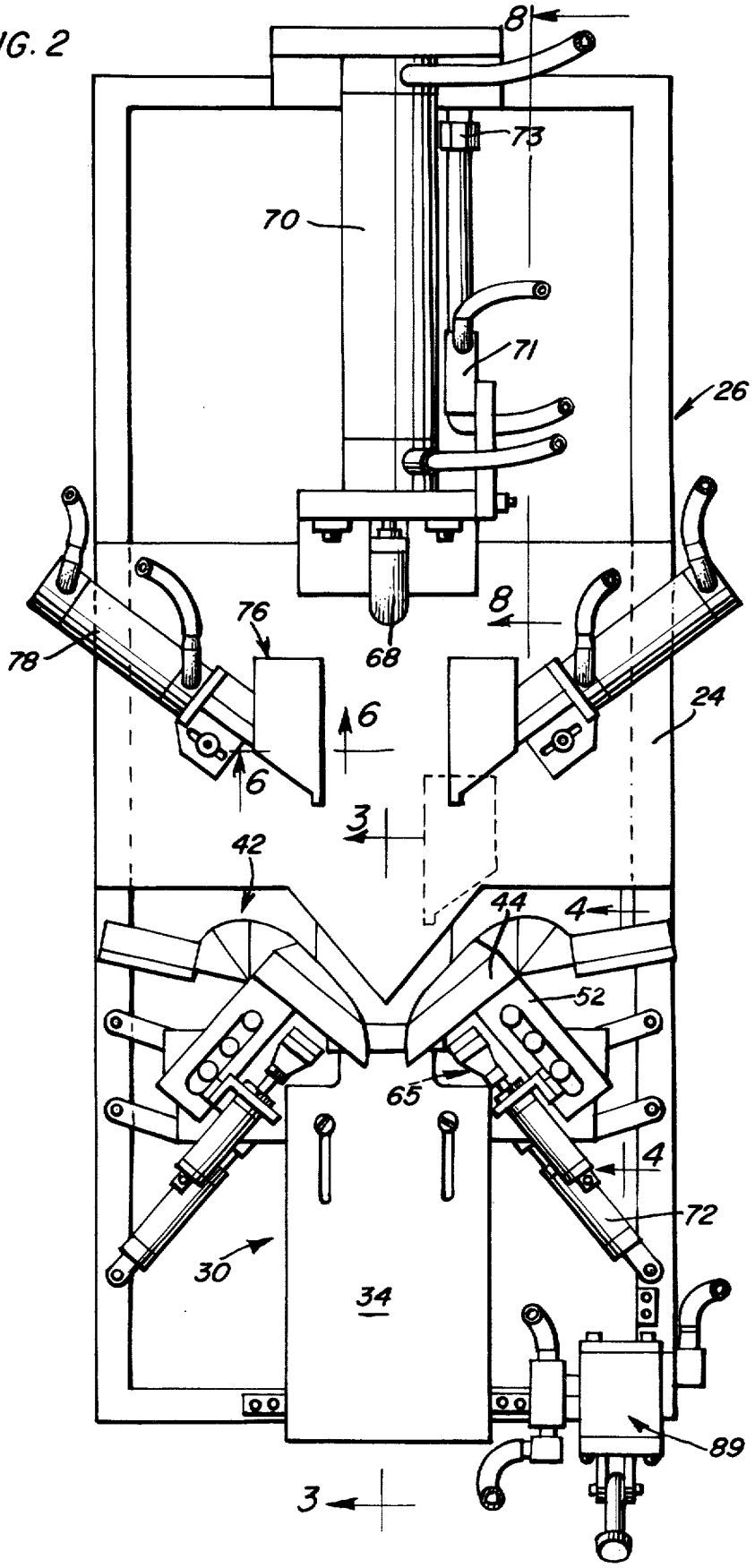
FIG. 2 is a top plan view of the automatic bagging apparatus in accordance with one embodiment of the present invention.
Figure 3:
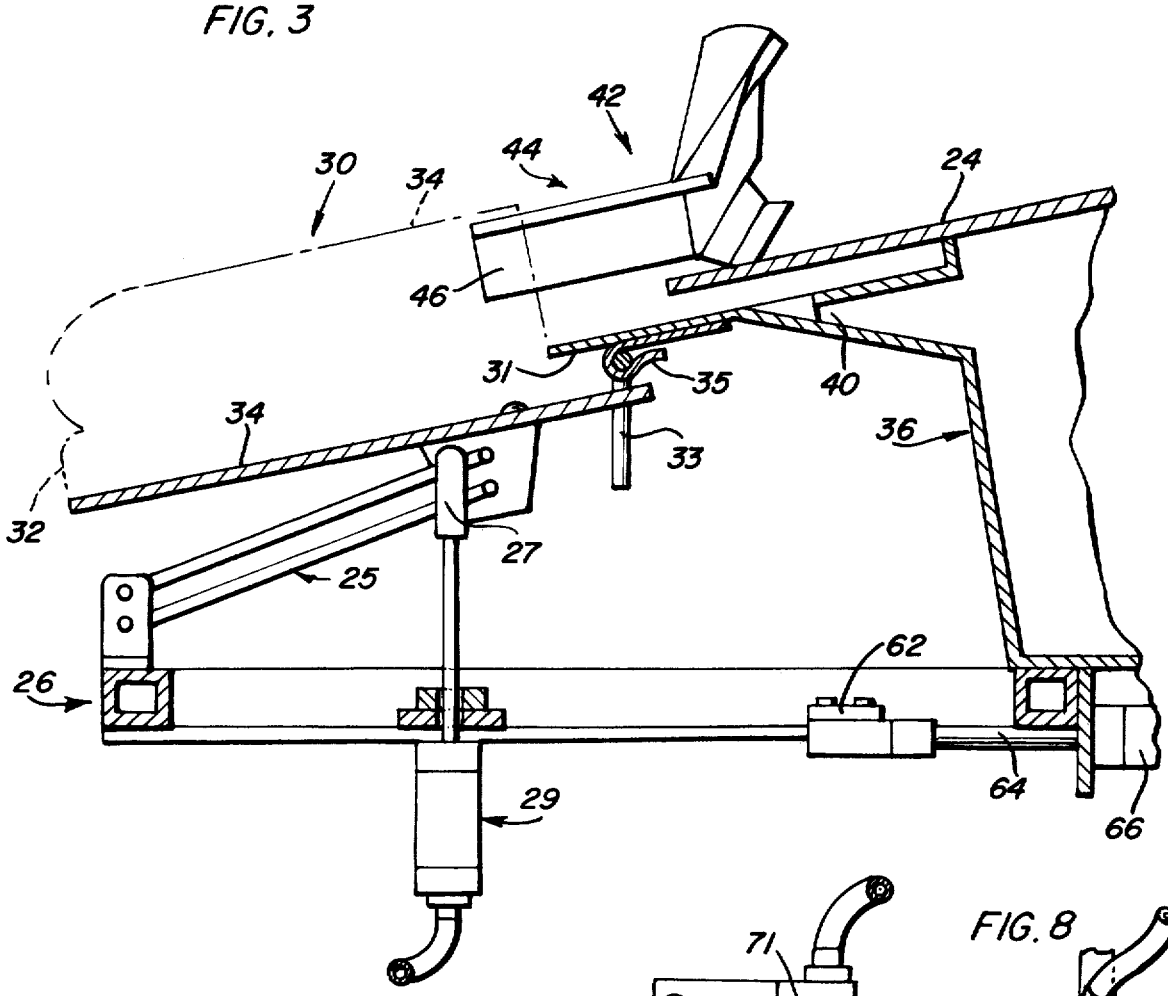
FIG. 3 is an enlarged partial section view taken substantially through a plane indicated by section line 3—3 in FIG. 2.
Figure 5:
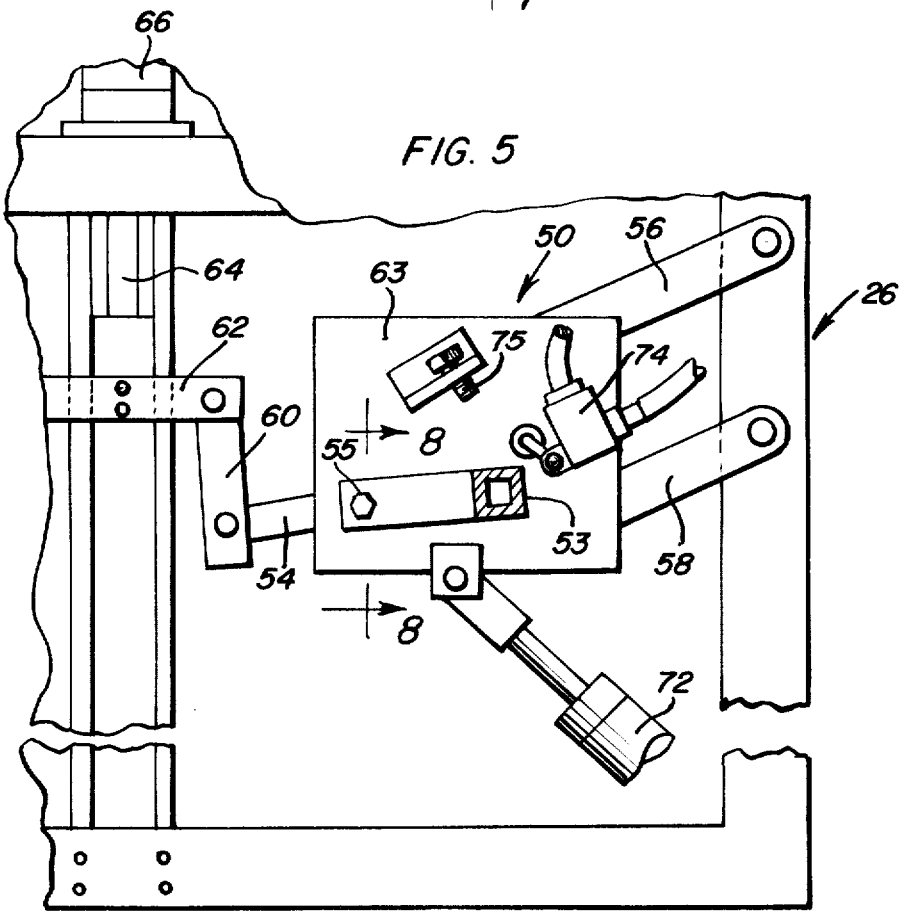
FIG. 5 is a section view taken substantially through a plane indicated by section line 5—5 in FIG. 4.

As shown in FIG. 2, the nozzle assembly 42 in the retracted position forms a convergent entry passage between the nozzle members 44 which are projected into the open bag during a first stage of operation, while the plates 63 are maintained substantially stationary. Such first stage of operation is characterized by pivotal movement of the nozzle members 44 about the axis of the pivot assembly 61 which is then stationary. At the end of such first stage, the sides 46 of the nozzle members are substantially parallel to the sides of the bag and a sensor 74 mounted on plate 63 is actuated by the post 53 as shown in FIG. 5. The second stage of operation then ensues during which the pivot 61 is movable in response to extension of a stage control piston device 72 pivotally mounted on the frame 26. The piston rod extending from piston device 72 is therefore pivotally connected to the plate 63 as shown in FIG. 5 in order to effect translation of the nozzle members laterally outwardly and in the direction of entry. Enlargement of the opened end portion of the bag and stretching of its film material to some extent is thereby effected as described in our copending application aforementioned. Also, bag clamping devices 65 mounted by brackets 67 on the arms 52 are actuated during the second stage of operation to clamp the bag at the open end portion to the nozzle members 44.

Figure 8:
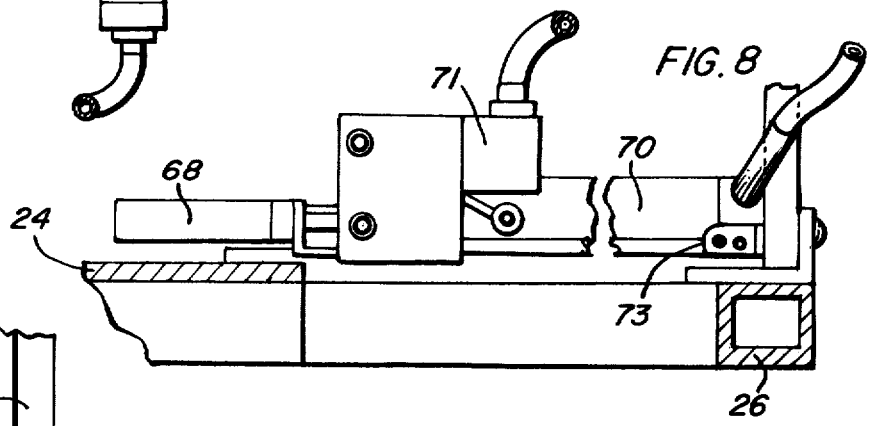
FIG. 8 is an enlarged partial section view taken substantially through a plane indicated by section line 8—8 in FIG. 2.

As shown in FIGS. 1 and 2, a packing ram 68 is positioned above the inclined slide surface 24 and connected to the piston rod of a ram control device 70. The ram is advanced along the path of entry parallel to the surface 24 by the piston control device 70 to complete the second stage of nozzle operation. Thus, the product is packed into the bag enlarged by the nozzle assembly 42 during the second stage of nozzle operation. Upon completion of the ram stroke, a limit sensor 71 as more clearly seen in FIGS. 2 and 8 is actuated by actuator 73 connected to the ram to effect retraction of the ram simultaneously with retraction of the nozzle assembly and the clamping devices 65 after the bird is fully packed into the bag.

When the bird is fully packed into the bag by the ram, the bag becomes detached from the supply rack. Detachment is occasioned by rupture of the flap of the bag at the holes through which the holder 33 extends. The bagged product on the top of the stack of bags will therefore be displaced onto a receiving surface.

In order to control the two stage movement of the nozzle assembly 42, each piston device 72 holds one of the plates 63 stationary during the first stage of operation to constrain nozzle members 44 to pivotal movement about the axes of pivots 61. When the side portions 46 of the nozzle members reach positions parallel to the sides of the bag at the end of the first stage, the sensor 74 is actuated by post 53 detecting the end of the first stage. Movement of the post 53 by operation of the piston control device 66 is limited by an adjustable stop 75 on plate 63 as shown in FIG. 5. The second stage of operation then ensues with continued operation of the piston device 66 accompanied by operation of the piston devices 72 in retracting directions to impart a translatory motion to the nozzle members 44 causing laterally outward movement of the nozzle members relative to the entry path direction.

Figure 6:
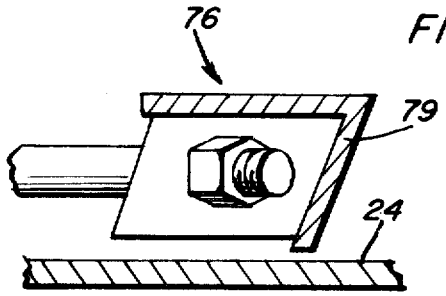
FIG. 6 is an enlarged partial section view taken substantially through a plane indicated by section line 6—6 in FIG. 2.

During second stage operation of the nozzle assembly, a pair of product positioning elements 76 are advanced toward each other laterally of the direction of the entry path and parallel to the slide surface 24, by associated piston control devices 78 mounted on surface 24 as shown in FIGS. 2 and 6. The elements 76 have confronting product engaging portions 79 as shown in FIG. 6 that are angled to converge upwardly and thereby prevent any upward displacement of the product from the slide surface when engaged. Thus, the positioning elements when actuated orientate the product for alignment thereof with the path of entry into the opened bag.

Figure 9:
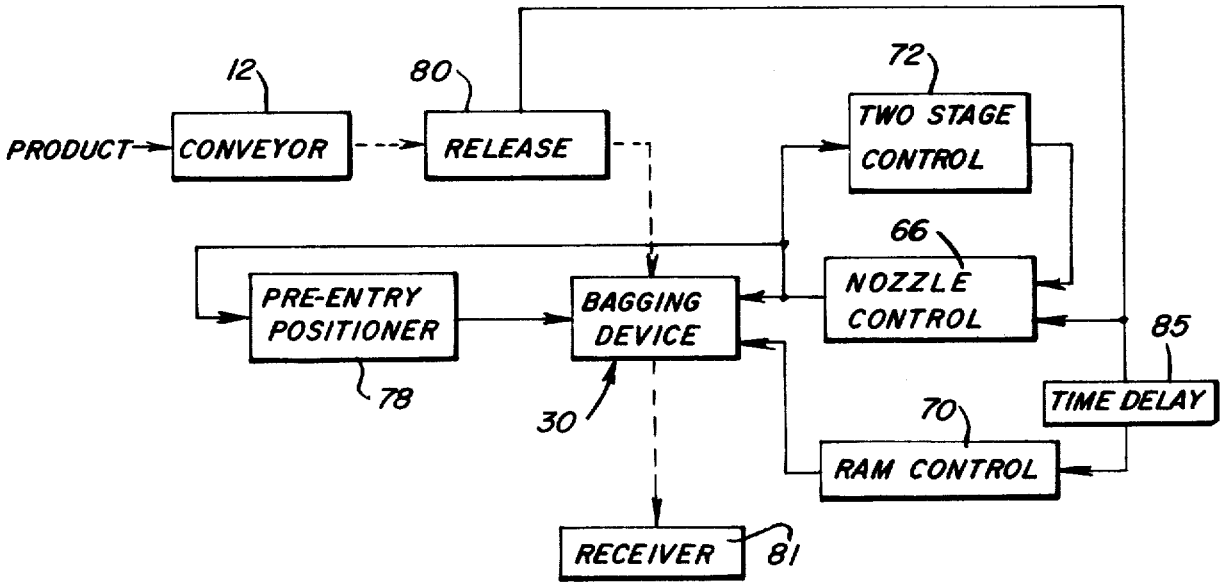
FIG. 9 is a schematic block diagram illustrating the control system associated with the present invention.

FIG. 9 diagramatically illustrates the control system of the present invention in relation to movement of a product by the conveyor 12 to the bagging station at which the product is automatically released by a release mechanism 80 so that the product may drop into the bagging device 30. The bagged product is then dropped onto a receiver 81. The bagging device is operationally controlled by the nozzle control device 66, the stage control devices 72 and the ram packing control device 70 as aforementioned. Also, the pre-entry positioner control devices 78 act on the product as aforementioned. The controls 66, 70, 72 and 78 according to one embodiment of the invention are supplied with fluid under pressure for operation thereof. An automatic bagging cycle is initiated upon receipt of a product release signal through signal line 84 operative on the nozzle control 66. Stage controls 72 are rendered operative at the end of the first operational stage to effect a second stage operation through control 66 and cause operation of the positioner controls 78. The ram control 70 is operated after a suitable delay dictated by a time delay device 85.

Figure 10:
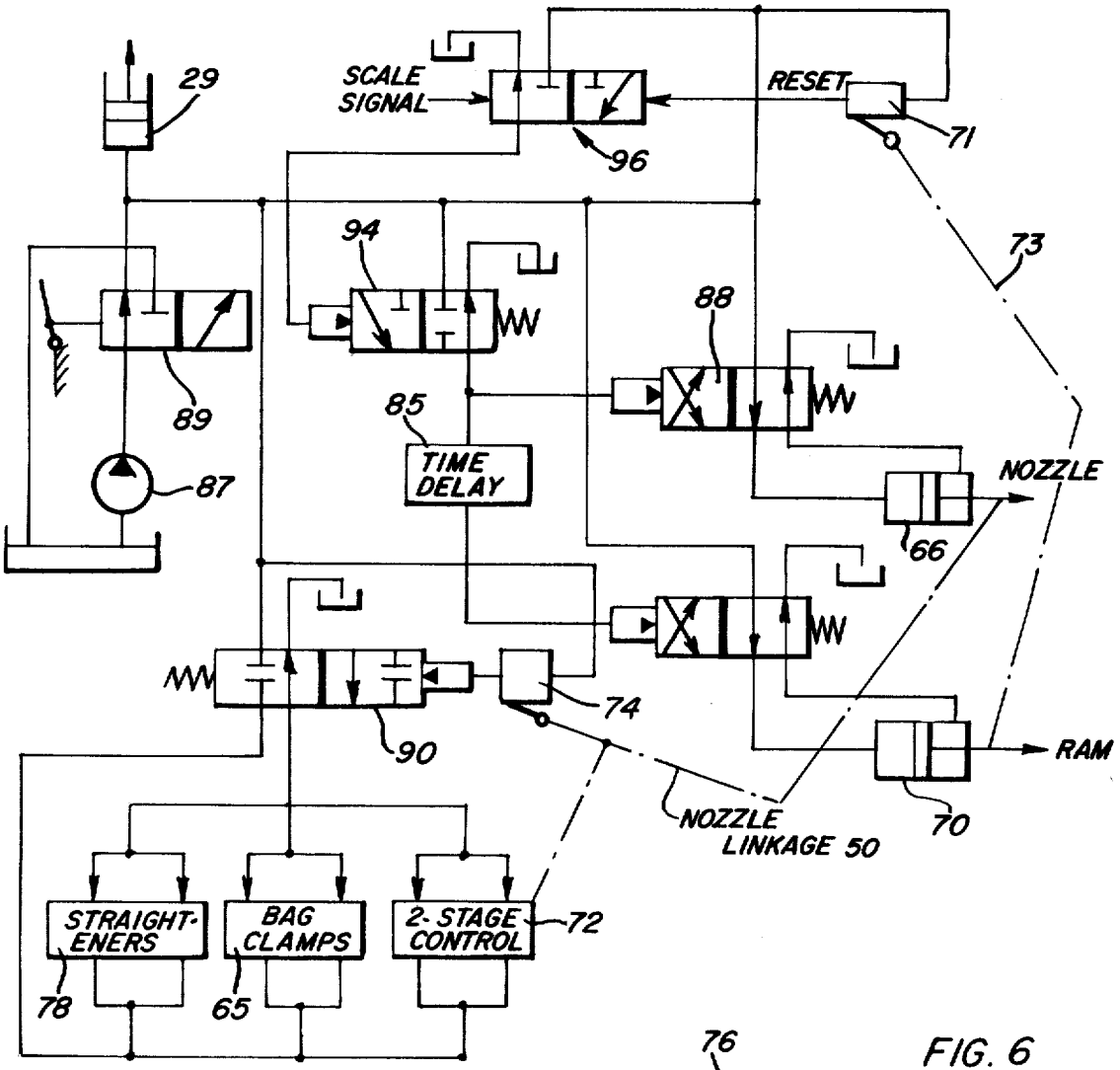
FIG. 10 is a fluid circuit diagram illustrating in greater detail the control system associated with the present invention.

An automatic control circuit for the system is shown in FIG. 10. A fluid operating medium is utilized for the various controls aforementioned, such as pressurized air from a suitable pressure source 87 fed through a manually operable shut-down valve 89 to pressure supply line 86 from which the operating medium is fed to signal actuated control valves 88, 90 and 92. The pressure fluid from line 86 is also supplied to the stage control sensor 74 actuated by the nozzle linkage assembly 50 as aforementioned and to a signal control valve 94. The signal control valve 94 when actuated by a signal received through signal line 84 from a scale operated signal generator valve 96, supplies a pressure signal directly to control valve 88 for nozzle operation and through delay device 85 to control valve 92 for delayed ram operation. The control valve 90 when actuated through sensor 74, effects simultaneous operation of the positioner controls 78, the bag clamp controls 65 and the stage nozzle controls 72.

An operational bagging cycle is begun by a release of a bird at the bagging station producing a pressure signal in line 84 through signal generator valve 96 to actuate control valve 88. As a result, the nozzle control 66 projects the nozzle assembly into the open bag in advance of the descending bird by initiating the first stage of operation. The second stage of operation is begun by link actuation of sensor 74 to actuate control valve 90 causing simultaneous operation of the control devices 78, 65 and 72. After a suitable delay, the control valve 92 is actuated to operate the ram control device 70. When the ram 68 completes its operational stroke, the reset limit sensor 71 is engaged through actuator 73 to deactivate the signal generator 96 causing a simultaneous reversal of the nozzle control 66, ram control 70, positioner controls 78, clamp controls 65 and stage controls 72 by return of the control valves 88, 90 and 92 to the initial positions under spring bias.

The manually operable valve 89, which may be mounted on the frame 26, as shown in FIG. 1, may be displaced to a cut-off position for shutdown purposes. In the actuated position shown, the valve 89 conducts pressurized fluid to not only the pressure supply line 86, but also to the fluid pressure bias device 29 for exerting a continuous upward bias on the bag rack plate 34 as aforementioned.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a moving conveyor from which a product is dropped at a bagging station for guided movement along an inclined path into an opened bag through an entry passage established by a nozzle projected into the bag, positioning means engageable with the product during travel along said path prior to entry into the bag through the nozzle for alignment with the entry pasage, and ram means for packing the product into the bag following said alignment thereof.

2. The combination of claim 1 wherein said inclined path is established by a fixed slide surface onto which the products are dropped, said surface being positioned at an incline of less than 45°.

3. The combination of claim 2 wherein said product is poultry suspended from the conveyor.

4. The combination of claim 1 wherein said product is poultry suspended from the conveyor.

5. In combination with a fixed slide along which a product is guided into a flexible container having an opened end portion, nozzle means projected into the opened container during movement of the product along the fixed slide, control means operatively connected to the nozzle means for expansion thereof to enlarge said opened end portion of the container and for withdrawal of the nozzle means following entry of the product into the container, said product being of a size relative to the container to produce a close fit package by contraction of the container onto the product in response to said withdrawal of the nozzle means, reciprocable ram means engageable with the product prior to entry thereof into the enlarged container for displacing the product fully into the container, means for withdrawing the ram means from the container simultaneously with said withdrawal of the nozzle means, and positioning means engageable with the product on the slide prior to entry into the container for alignment thereof, with said opened end portion of the container.

6. The combination of claim 5 wherein said product is of a size relative to the bag to enable contraction of the expanded bag onto the product in response to withdrawal of the nozzle means and the ram means following projection thereof into the bag.

7. In combination with a moving conveyor from which an object is dropped at a bagging station for guided movement through an entry passage into an opened bag, nozzle means for establishing said entry passage, control means connected to the nozzle means for projection thereof into the bag, positioning means engageable with the product for alignment thereof with said entry passage, and ram means engageable with the product for packing thereof into the bag following said alignment of the product and projection of the nozzle means into the bag.

8. The combination of claim 6 wherein the bag is dimensionally expanded by the nozzle means.

9. A stretch bagging apparatus, comprising an upright frame and translatable plate means upon said frame, a stretch bag rack mounted at a bagging end of said frame so as to support a plurality of open ended stretch bags in superposed relationship with a top open ended bag in operative relationship to said plate means, nozzle means including a pair of transversely reciprocable bag opening horns mounted on said plate means, an actuating mechanism being first actuated to open transversely said nozzle means so as to stretch the bag as said horns advance into the top bag, said actuating mechanism being second actuated to close transversely said nozzle means sequentially as said horns and plate means are translated relative to the bag rack, a pressurized air actuation system, including a source of pressurized air, a reciprocating cylinder supported in said frame and engageable with the plate means, a bag opening cylinder supported in said frame and engageable with said actuating mechanism, and a bag opening jet duct with an open end supported adjacent said bag opening horns, such that pressurized air is diverted into said open ended bag during each bag opening operation.

10. The bagging apparatus as in claim 9, said pressurized air actuation system further including a timed release logic system and valving mechanism actuatable to sequentially open via air jet a top most stretch bag, advance said plate means and transversely open said nozzle means, retract the plate means and transversely close the nozzle means.

* * * * *